United States Patent [19]

Thompson et al.

[11] 4,445,351

[45] May 1, 1984

[54] FLUIDIZED BED LUBRICANT CONTAINER

[75] Inventors: Gary J. Thompson, Akron; C. H. Carey, Cuyahoga Falls, both of Ohio

[73] Assignee: Morgan Construction Company, Worcester, Mass.

[21] Appl. No.: 357,928

[22] Filed: Mar. 15, 1982

[51] Int. Cl.[3] ..... B21C 9/00

[52] U.S. Cl. ..... 72/43

[58] Field of Search ..... 72/41, 43, 44, 45, 42; 184/6.23, 15 R; 427/185, 213

[56] References Cited

U.S. PATENT DOCUMENTS

| | | | |
|---|---|---|---|
| 2,088,040 | 7/1937 | Simons | 72/42 |
| 2,199,495 | 5/1940 | Johnson | 72/44 |
| 3,070,837 | 1/1963 | Loertscher et al. | 18/2.7 |
| 3,202,731 | 8/1965 | Grevenstuk et al. | 264/7 |
| 3,413,832 | 12/1968 | Lang et al. | 72/42 |
| 3,560,239 | 2/1971 | Facer et al. | 427/185 |
| 3,763,680 | 10/1973 | Godfrey et al. | 72/43 |
| 4,066,430 | 1/1978 | Franz | 65/116 |

FOREIGN PATENT DOCUMENTS

| | | | |
|---|---|---|---|
| 53-44905 | 12/1978 | Japan | 72/42 |
| 412970 | 1/1974 | U.S.S.R. | 72/43 |
| 757228 | 9/1980 | U.S.S.R. | 72/44 |

OTHER PUBLICATIONS

"Continuous Wire Oil Tempering in a Fluidized Bed Furnace," by H. K. Staffin, John S. Maxson, Jr., and Robert Staffin, appearing in *Wire Journal*, Oct. 1981, pp. 80–84.

*Primary Examiner*—E. Michael Combs

*Attorney, Agent, or Firm*—Thompson, Birch

[57] ABSTRACT

A fluidized bed die container holding a lubricant compound receives material which is to be reduced in a die. Pressurized air entering the bed beneath the lubricant agitates the particles to fluidize them so that contact is continually assured between the lubricant and the material, and the pressurized air is used to help cool the die.

9 Claims, 1 Drawing Figure

FLUIDIZED BED LUBRICANT CONTAINER

BACKGROUND OF THE INVENTION

Figure 1:
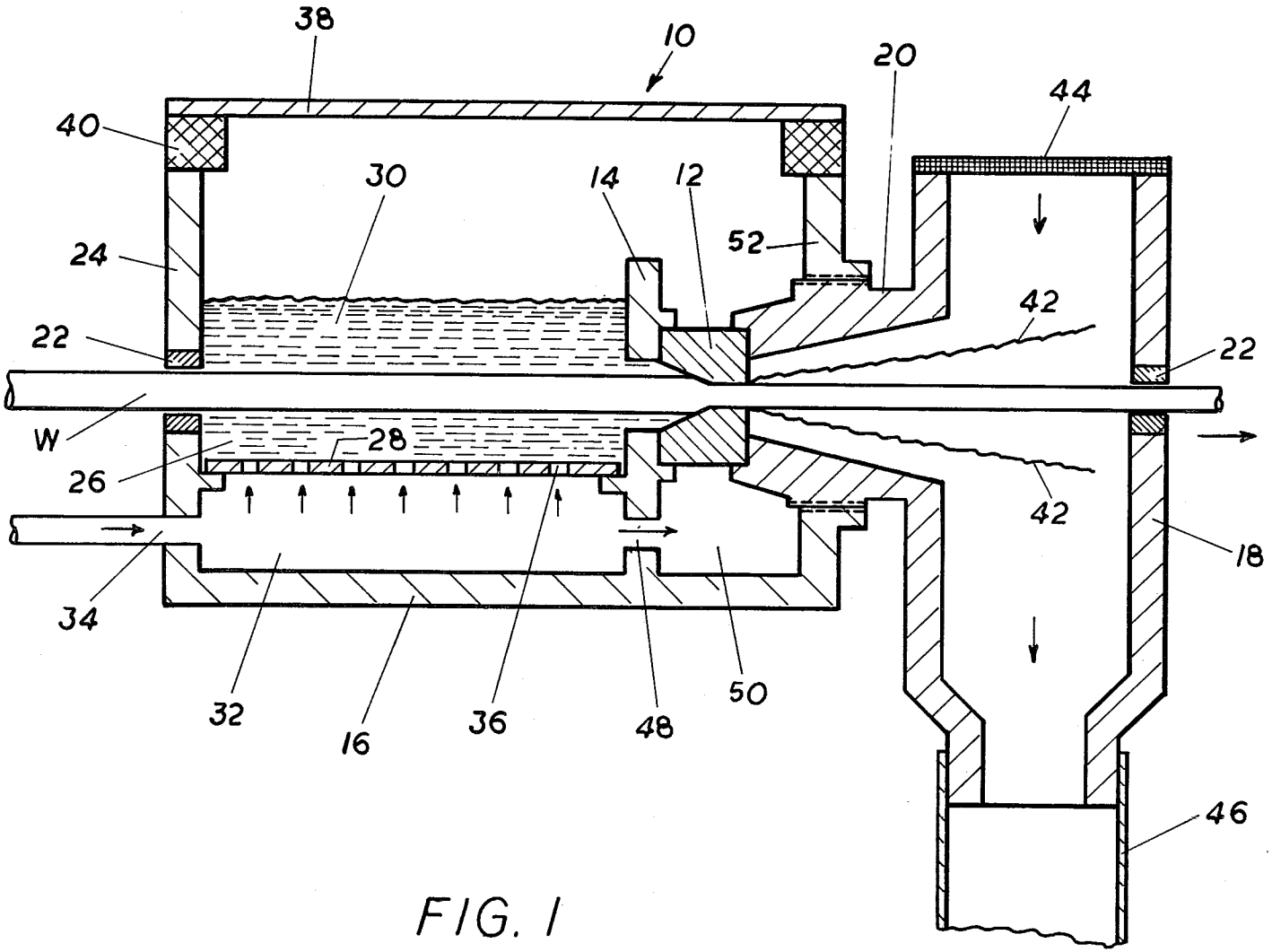

The invention relates to the lubrication of a material, such as wire, rod, or tube prior to its entrance into a reduction die, and the cooling of the die during the reduction process.

In the cold or hot drawing of filamental material, such as rod, wire, or tube and the like in a continuous drawing operation, it is the common practice to apply a lubricant compound to the material prior to its entry into a reduction die. This is done by providing a container of lubricant and passing the material therethrough. When the drawing machine runs at a high range of speeds, the lubricant, being a dry granular soap compound, has a tendency to aggregate concentrically around and away from the material during its course of travel. In the art this is known as creating a "tunneling effect". During this "tunneling effect" contact between the lubricant and the material is prevented from being made, thus resulting in either a dry or an insufficient lubricated material entering the die. This can result into several undesirable conditions; i.e., an increase in friction, and therefore an increase in heat transferred to the material; excessive wear to the die, etc.

In order to alleviate the problems associated with a non-sufficient lubrication of the material, prior production attempts were to agitate the lubricant container so that the lubricant would make contact with and hopefully be evenly distributed along the surface of the material. This was done either by an external mechanical device attached to the container or by a workman manually agitating the material.

While in limited applications such attempts have realized some success, they have not been sufficiently dependable, efficient, nor effective, and are not capable of fully taking into account changes in speed and size of the material.

In the reduction process, heat is generated in the reduction die. In the past, cooling of the die has been done mainly by water. However, leaks in the system has resulted in inefficient cooling and also in unsightly, hazardous working area conditions.

SUMMARY OF THE INVENTION

It is therefore, an object of the present invention to improve the working area conditions and to decrease the man power and cost production involved in the present means and methods of agitating a lubricant in a material drawing process.

It is a further object of the present invention to provide an improved means and a method thereof to automatically and internally lubricate a material by agitating or fluidizing a lubricant compound in a manner to assure continual contact between the lubricant and the material.

It is a further object to apply "fluidized bed" concepts to a lubricating process particularly in a wire drawing operation to lubricate the wire by injecting a pressurized fluid beneath a bed of dry soap particles to move the particles upward to the extent that they separate and the spaces between them are filled with the fluid, and thus, this means and method eliminates the "tunneling effect" by causing the particles to be continually forced in an uniform manner against the material, and provides a more efficient cooling of the die.

And yet a still further object of the present invention is to provide a means and a method thereof used in combination with a die assembly through which filamental material travels to be reduced, and which prior to said material entering said die assembly, a dry granular lubricant compound is applied to said material upon its path of travel, a material lubricant assembly comprising a container means arranged adjacent to the entry side of said die assembly, comprising an enclosure for retaining said lubricant and constructed to receive said material in a manner to cover a substantial portion of said material with said lubricant prior to its entry into said die assembly, plenum chamber means associated with said enclosure for receiving pressurized fluid, and means for dividing said enclosure from said chamber means including means constructed and arranged for uniformly directing said pressurized fluid into said lubricant in a manner to fluidize said granules of said lubricant compound so as to cause said lubricant to completely and uniformly adhere to said material.

These and other objects of the present invention will become more apparent and better appreciated when the following description is read along with the accompanying drawing of which:

FIG. 1 is a cross sectional, elevational view depicting the present invention, employed with a wire drawing die assembly.

In referring to FIG. 1, there is shown a material lubricant assembly or arrangement 10 for supporting a die assembly 12 used in the reduction of a carbon steel wire. The die assembly 12 is housed and supported at the back face by a member 14 of a rectangular, enclosed horizontally arranged metal lubricant container 16. To the right of this FIG. 1, a vertical metal tube 18, which may be steel or brass, has a funnel portion 20 having threads which are secured into a corresponding threaded portion of the container 16. The diameter of the tube 18 is approximately 4 inches O.D. and 4 inches long. A section of the funnel portion 20 abuts the front face of the die assembly 12 when assembled with the container 16.

In order to guide the wire through and to protect the metal container 16 and tube 18 from the traveling wire, hardened steel bushings 22 are provided at both the entrance and the exit sides of the arrangement 10. The wire upon its travel from left to right when referring to this Figure, passes through the container 16, into the die assembly 12, and then through the vertical tube structure 18. The die assembly 12 securely fits into a collared portion of member 14 and into a collared portion of funnel portion 20 to securely hold it in place for the wire drawing operation.

Member 14 cooperates with sidewall 24 of container 16 to form an enclosure 26 and to support an orifice plate 28. The dry lubricant granules 30 are often referred to interchangeably in the trade as powdered lubricants, metal working products, or soap powders and are placed upon the orifice plate 28 which runs parallel to the wire's travel. A known suitable, commercially available lubricant may be STEELSKIN ®, offered and manufactured by Pennwalt Corporation, New York, which takes the form of a fine sand-like granule. Orifice plate 28 is rectangular in shape and extends across the entire width and length of the enclosure 26 to separate and divide the lubricant 30 from the bottom of the container 16 which portion is called a plenum chamber 32. In the preferred embodiment pressurized fluid, preferably air, ranging between 1 to 15 psi is injected through inlet port into plenum chamber 32. Numerous minute holes 36 shown in exaggerated form along the width and length of orifice plate 28 communicate with the chamber 32 and the lubricant 30 to permit the passage of the pressurized air up into the enclosure 26 containing the lubricant 30.

Prior to the application of the pressurized air into the chamber 32, the lubricant is poured into the enclosure 26 an amount at least approximately one inch above the wire line.

Fluidization of the lubricant which involves a travelling of the pressurized air up through the holes 36 into the lubricant 30 to agitate the particles to cause them to swirl thereby contacting the wire, does not increase or raise the level of the lubricant any appreciable amount. This suspension or levitation of the particles has the characteristics of a liquid phase, and is commonly referred to as a fluidized state.

As is recognized in fluidized bed concepts, the plate must be of a particular design and this is also the case of the orifice plate 28 in the present invention. The holes 36 in the plate 28 are of a dimension and/or an arrangement such as to uniformly distribute the pressurized gas up into the lubricant, and to prevent the soap particles from dropping into the plenum chamber when the air is not on. Since there is a negligible amount of heat transferred in the fluidization of the lubricant, it is not necessary that the plate be able to withstand extreme temperatures, and therefore, the material can be styrofoam or plastic. In addition, instead of the construction for the orifice plate 28 shown in the Figure, a porous material can be utilized.

On top of container 16 is a cover 38, and between the walls of the container 16 and the cover 38 is a porous foam seal 40 which permits a substantial amount of pressurized air to escape out of the container into the atmosphere thereby avoiding a pressure build-up that would adversely effect the desired fluidized condition. Cover 38 is securely held in place by fastening means, not shown, and is easily removed for access into the container 16.

When the container 16 is filled to a desired level above the wire line, under a continuous operation of the wire drawing process, there is enough lubricant in the enclosure to last at least 8 hours at which time the supply of lubricant should be replenished. A reason for the decrease in the supply of lubricant is that the lubricant adheres to the wire and is drawn through the die where due to the high pressure and friction it is "burned off" or carbonized, forming streams of black shavings or thin soap strips as shown at numeral 42 in FIG. 1.

As the length of the shavings increases within the funnel portion 20 and extends into the tube 18, they are shortened or severed by permitting a flow of air to be directed into a screened portion 44 on top the tube 18. The air not only reduces heat in the wire but it also aids in carrying the severed shavings downward through the tube as negative air pressure of a vacuum system hose 46 connected to the bottom of the tube structure 18 carries the shavings away from the system. The pressurized air in plenum chamber 32 is directed through a channel 48 into an enclosure 50 which is formed by member 14, sidewall 52 and funnel 20. This pressurized air provides a cooling effect to the die assembly 12 whereby the amount of water used in previous die cooling operations may be decreased or eliminated entirely.

In a complete wire drawing operation, one to twelve of these fluidized bed container assemblies 10 as shown in FIG. 1 may be arranged in tandem, the speeds ranging from 100–3000 feet per minute respectively from the first to the last die assembly container. The diameter of the wire may measure 0.040 to 1.75 inches prior to the reduction process. The type of wire and its drawing speed determines the type of lubricant used in the process. The air pressure can be increased or decreased to change the amount of agitation of the lubricant and there exists a minimum pressure and flow required to fluidize different types of lubricant. The pressure of the air and the size of the lubricant particulates remain fairly constant in any given wire drawing operation.

While during the operating period there will be a constant depletion of the lubricant in which more lubricant will be used up through the first part of the operation where its concentration is greater, the fluidized application will assure that the required minimum amount of lubricant will always be applied to the wire and will uniformly and completely cover the section passing through the container 16.

The fluidized application of the lubricant will insure that an adequate supply of lubricant will be applied at initial draws on new wire which requires more lubricant than subsequently drawn wire. This is due to the rougher surface condition of new wire. Because of the greater lubricant requirement on initial draws, the tunneling effect is much more evident. The fluidized lubricant eliminates the additional time previously required of the operator at the initial draw die boxes used with a non-fluidized lubricant.

It will be appreciated that while the present invention has been disclosed in conjunction with a wire drawing operation it is equally useful in other applications, such as rod or tube, and may take different forms and will be automated to control the air pressure as operating conditions may change, and if desirable provided with a continuous lubricant feed system.

In accordance with the provisions of the patent statutes, we have explained the principle and operation of our invention and have illustrated and described what we consider to represent the best embodiment thereof.

We claim:

1. In combination with a die assembly through which filamental material travels to be reduced, and which prior to said material entering said die assembly a dry granular lubricant compound is applied to said material upon its path of travel and when in said die assembly, heat is generated in the reduction process, a material lubricant assembly comprising:

a container means, comprising:

a first enclosure for retaining said lubricant and constructed to receive said material in a manner to cover a substantial portion of said material with said lubricant prior to its entry into said die assembly, a second enclosure adjacent said first enclosure for housing said die assembly, plenum chamber means associated with said first enclosure and communicating with said second enclosure around said die assembly for receiving pressurized fluid, dividing means for forming said first and said second enclosures and said plenum chamber, including means between said plenum chamber and said first enclosure constructed and arranged to uniformly direct said pressurized fluid into said lubricant in a manner to fluidize said granules of said lubricant compound so as to cause said lubricant to adhere uniformly to said material, and further including means between said first enclosure and said second enclosure for supporting said die assembly and constructed and arranged in a manner to restrict the flow of said fluidized granules in said first enclosure, and means for delivering said pressurized fluid into said plenum chamber where said pressurized fluid travelling into said second enclosure and circulating around said die assembly remains substantially free of said lubricant granules and acts to cool said die assembly.

2. In combination according to claim 1, wherein said material lubricant assembly further includes:

a removable cover, and a porous sealing element arranged beneath said removable cover to permit said pressurized air to escape from said material lubricant assembly.

3. In combination according to claim 1, wherein said material with said adhering lubricant enters said die assembly and said lubricant has a tendency to carbonize thereby forming streams of shavings, further comprising:

air supply means located adjacent said die assembly for receiving said material and said carbonized shavings and including means for directing a flow of air in a manner to cool said material and to sever and carry said shavings away from said path of travel.

4. In combination according to claim 3, wherein said air supply means supplies negative air pressure and includes means cooperating with said container means to mount and support said die assembly in said material lubricant assembly, and means for securing said air supply means to said material lubricant means.

5. A lubricant assembly through which material to be lubricated travels through a die assembly for reduction thereof wherein heat is generated, comprising:

container means for retaining a dry lubricant granular compound at a predetermined level and including means for guiding said material through said compound, means for delivering a pressurized fluid to said lubricant constructed and arranged in a manner to fluidize the granules of said compound to agitate them around said material so as to cause said lubricant to adhere uniformly to said material, and means for delivering said pressurized fluid to said die assembly including means for separating said fluidized granules from said die assembly constructed and arranged in a manner that said pressurized fluid delivered to said die assembly is substantially free from said lubricant granules and circulates around said die assembly for cooling thereof.

6. In a method of lubricating a material in a lubricant assembly through which said material travels through a die assembly for reduction thereof wherein heat is generated during the reduction process, and wherein said lubricant assembly supports said die assembly, the steps comprises:

retaining a dry lubricant granular compound at a predetermined level above said material prior to and during its travel, delivering a pressurized fluid into said lubricant to fluidize said granulars to cause them to circulate around said material in a manner that they adhere uniformly to said material, delivering said pressurized fluid around said die assembly for cooling thereof, and separating said pressurized fluid delivered to said die assembly from said fluid delivered to said lubricant in a manner that said delivered fluid around said die assembly is substantially free of said fluidized granulars of said lubricant compound.

7. In combination with a die assembly through which filamental material travels to be reduced, and which prior to said material entering said die assembly, a material lubricant assembly applies lubricant to said material upon its path of travel, the steps comprising:

supporting said material upon its path of travel into and from said lubricant assembly and said die assembly, passing a length of said material through a source of dry granular lubricant compound prior to its entry into said die assembly, while said material is passing through said compound, applying a continuous source of pressurized fluid into said lubricant compound to create a fluidized state so that said granules are agitated to the extent they uniformly cover said material, restricting said lubricant compound in said fluidized state to flow only around said material, and while said pressurized fluid is creating said fluidized state, causing a portion of said fluid to be directed around said die assembly for cooling thereof during the reduction process, while maintaining said portion substantially free of said lubricant granules.

8. In combination according to claim 7, wherein said adhering lubricant in said die assembly has a tendency to carbonize thereby forming streams of shavings, the steps further comprising:

upon said material exiting from said die assembly, directing pressurized air to said material and said shavings to cool said material and to sever and carry said shavings away from said path of travel.

9. In combination according to claim 8, wherein said pressurized air is supplied by a vacuum means.

* * * * *